United States Patent [19]

Parrish et al.

[11] Patent Number: 5,018,955

[45] Date of Patent: May 28, 1991

[54] DECORATIVE CURBING MACHINE

[75] Inventors: Robert W. Parrish, 320 W. 200 North, Suite X, Layton, Utah 84041; Walter F. Parrish, Layton, Utah

[73] Assignee: Robert W. Parrish, Layton, Utah

[21] Appl. No.: 379,071

[22] Filed: Jul. 13, 1989

[51] Int. Cl.[5] ..... B28B 1/29; B28B 13/06

[52] U.S. Cl. ..... 425/64; 249/2; 404/98; 425/65; 425/146; 425/262

[58] Field of Search ..... 425/63, 64, 65, 262, 425/145, 146, 209; 249/2; 404/98, 96, 97

[56] References Cited

U.S. PATENT DOCUMENTS

| | | | |
|---|---|---|---|
| 2,707,422 | 5/1955 | Canfield | 404/98 |
| 3,137,220 | 6/1964 | Smith | 404/98 |
| 3,138,079 | 6/1964 | Smith | 404/98 |
| 3,175,478 | 3/1965 | Smith | 425/64 |
| 3,261,272 | 7/1966 | Jennings | 404/98 |
| 3,292,511 | 12/1966 | Cheney | 404/84 |
| 3,363,524 | 1/1968 | Catenacci | 425/64 |
| 3,507,015 | 4/1970 | Heatlie | 425/64 |
| 3,530,552 | 9/1970 | Calder | 425/62 |
| 3,600,773 | 8/1971 | Davis | 425/63 |
| 3,605,580 | 9/1971 | Miller | 404/84 |
| 3,733,140 | 5/1973 | James, III | 404/98 |
| 3,733,141 | 5/1973 | James, III | 404/98 |
| 3,864,858 | 2/1975 | Rochfort | 404/98 |
| 3,890,055 | 6/1975 | Rochfort | 404/98 |
| 3,904,341 | 9/1975 | Putti | 425/64 |
| 3,915,584 | 10/1975 | Coho, Jr. et al. | 404/98 |
| 4,084,928 | 4/1978 | Petersik | 425/114 |
| 4,145,155 | 3/1979 | Ogaki et al. | 404/98 |
| 4,183,881 | 1/1980 | Griffin et al. | 425/6 |
| 4,566,823 | 1/1986 | May | 404/98 |
| 4,752,205 | 6/1988 | Moriyama et al. | 425/465 |

FOREIGN PATENT DOCUMENTS

| | | | |
|---|---|---|---|
| 545163 | 8/1957 | Canada | 404/98 |
| 610234 | 12/1960 | Canada | 404/98 |
| 643260 | 6/1962 | Canada | 404/98 |
| 1110370 | 6/1966 | United Kingdom | 404/98 |
| 2116620 | 9/1983 | United Kingdom | 404/98 |

*Primary Examiner*—Jay H. Woo
*Assistant Examiner*—Khanh P. Nguyen
*Attorney, Agent, or Firm*—Trask, Britt & Rossa

[57] ABSTRACT

An apparatus for continuously shaping and extruding concrete or other moldable material as a decorative curbing. The apparatus is operable by one person at high extrusion velocity, negotiates short radius serpentine curbing paths, and is maneuverable in tight spaces because of side-to-side and vertical adjustment features, and a short "wheel base". Moldable material is placed in a hopper and flows into an auger which compresses, mixes and extrudes the material through a shaped, non-flanged mold into the desired curb bed. A fueled engine or electric motor drives a hydraulic pump to pressurize hydraulic fluid. The pressurized fluid drives a hydraulic motor which turns the auger. The speed is controlled by simply setting a fluid flow valve.

13 Claims, 11 Drawing Sheets

DECORATIVE CURBING MACHINE

BACKGROUND OF THE INVENTION

1. Field of the Invention

This invention relates to machines used to form curbing and the like. More particularly, this invention relates to lightweight portable apparatus for extruding, shaping and laying continuous concrete curbing and similar elongate structures from mortar.

2. Information Disclosure Statement

Numerous patents exist which describe machines for laying street curbing. These machines are very large and require several, and sometimes up to eight or more persons to operate satisfactorily. One such machine is described in U.S. Pat. No. 3,600,773, to Davis. Concrete forms a curb in a mold as the machine is pulled by a winch-cable system. The machine is not adaptable to lay curbing in other than a straight line. Furthermore, the concrete is not extruded by an applied force, but is merely laid in the mold.

Other large machines for forming curbs or curb-like structures, each utilizing a ram for extruding the concrete, are described in U.S. Pat. Nos. 3,507,015 to Heatlie, 3,292,511 to Cheney, 3,530,552 to Calder, 3,363,524 to Catenacci, and 3,605,580 to Miller. The sinusoidal velocity profile of the ram results in an extrusion velocity cyclically varying between a maximum value and zero, or even between a maximum value and a smaller negative value. The velocity generally is zero or negative for one-half of the cycle. Thus, the actual mean velocity is always much lower than the desired maximum. Although the ram period may be shortened to smooth out the concrete movement from the extrusion mold, up to one-half of the motive energy is wasted by reverse movement of the ram through the concrete in each cycle. Furthermore, in order to prevent the ram from reversing the movement of concrete on the return stroke, thus destroying the curb integrity, these machines are designed to provide a large amount of slip. This also wastes considerable energy.

Some existing machines are driven by a single speed motor which extrudes a nearly constant mass of concrete per unit time. Since larger curbing requires more material per running foot, laying speed will be inversely proportional to the cross-sectional area of the curbing. Motors limited to driving the machine at a single speed cannot provide the range of speeds required for different sizes and shapes of curbs.

Curb laying apparatus which use an auger to compress the concrete or asphalt paving material are much more efficient than ram-operated machines, because the concrete or mortar is moved continuously forward at a velocity dependent upon the easily controlled auger speed (revolutions per minute). Thus, the machine may be operated at the optimum velocity for forming the particular curb. U.S. Pat. Nos. 3,053,156 and 3,261,272 of Jennings show a curb-laying apparatus using a belt-driven auger to pressurize the concrete. Front wheels and rear wheels are located near the forward and rearward extremes of the long machine, and when turns are made in a short radius, the discharge end of the mold becomes misaligned with the already-laid curbing. Canfield U.S. Pat. No. 2,707,422 shows a similar machine having somewhat different construction.

Another machine is described in U.S. Pat. No. 3,915,584 to Cobo, Jr. et al. This apparatus uses two coaxially aligned augers which allow curbing to be laid in either direction from the same side of the machine. In order to achieve a reversal of direction, the hopper must be removed from one auger and attached to the other auger, the front and rear wheels are interchanged, the mold is removed from one auger end, a mold of reverse configuration is attached to the other auger, and a cover means is secured over the open unused auger inlet as a safety measure.

Smith U.S. Pat. No. 3,137,220 describes a curb laying machine utilizing multiple augers to balance the extrusion forces within the mold.

All of the aforedescribed apparatus are designed for laying street curbing. The laying of decorative curbing differs considerably, since the use of datum and guide lines or forms is not practical. Decorative curbing is much smaller in cross-section than street curbing, and typically is laid serpentine fashion to enclose plantings, flower beds, trees, and the like. Often, it is desired to abut the curbing ends against structural foundations, walls, or other objects. Street curbing machines are too large and bulky, and have a wheel base too large to negotiate the short radius curves and limited operating space where decorative curbing is typically laid. They are not easily portable.

Simple hand-operated ram machines are shown in U.S. Pat. Nos. 3,733,140 and 3,733,141 of James, III. These machines are useful only for limited curb laying, because they are slow, cumbersome, and labor intensive.

A small curb extrusion device is shown in U.S. Pat. No. 4,566,823 of May. Concrete or other moldable material is extruded through a mold by the action of a motor-driven ram. The machine is limited by its ram operation to a cyclical speed whose average is considerably less than the desirable maximum speed for laying curb, and much energy of the motor is wasted. Changing molds is time consuming because disassembly of various parts is required. In addition, the cyclic ram movement tends to produce curbing with uneven cross-sectional area.

A problem particularly with any small ram-operated curbing machine is that unless it has a short stroke and is operated at high RPM, it may tend to produce curbing with alternating high compression and low compression sections.

Furthermore, the reciprocating ram operation makes it difficult to produce the curbing along the desired path, even when guide strings are used; the machine may tend to weave away from the path. Often, the curbing is later pushed into the desired path with a board. This must be done before the curbing hardens, and in any case may weaken the curbing. In large, street curbing machines, the use of at least four wheels provides four-point support to prevent the machine from wandering from the guide line.

SUMMARY OF THE INVENTION

The present invention is directed to a machine for continuously forming and extruding decorative curbing from mortar, concrete and other cementitious materials. The decorative curbing machine is compact, and has a short support base distance between the front wheels and the curb-forming extrusion mold which permits easy maneuvering around trees and shrubs, and next to buildings to form such curbing. It is easily adjustable to form curbs on slopes, and requires only one person for operation. A driven auger compresses the curb-forming material at an easily controlled continuous speed of extrusion. Its speed is not limited by the reciprocating action of ram driven machines, so that high quality curbing may be laid at a linear speed up to 16 feet per minute or more, 1.5 to 5 times that of existing ram-driven extruders used for producing decorative curbing. Extrusion of the curbing produces reactive forces which overcome frictional forces to propel the machine forward. The wheels require no separate driving force except when moving substantially uphill. Uphill movement may require manual force to achieve the desired curb formation, depending upon the degree of slope. Likewise, when operating on a downhill slope, a slight backward force may be required to keep the machine from moving faster than desired, and misforming the curbing.

Unlike other portable curb making machines, this machine is designed to be operated from either the front end, i.e., in a pulling position, or from the rear, i.e. a pushing position. In general, the "pushing" position permits more precise control over the operation, and is normally used to advantage with this machine. However, operations from either front or rear may be performed with this machine.

Unlike other machines for extruding decorative curbing, the extrusion mold in this machine is easily replaced, without removing attachment plates, mold supports, clamp assemblies, and compacting members. The mold is quickly and simply attached to the auger case by a press fit.

The apparatus of this invention comprises a manually maneuverable extruder-propelled apparatus for continuously forming and extruding elongated decorative curbing and the like from mortar or mortar-like material. The apparatus has an auger mounted on a auger shaft supported and rotatively driven at a first end to compress and extrude the material axially toward and unsupported second end. The auger is contained in an auger housing, whose inner surface is nearly proximate the outer diameter of the auger for minimal slippage of mortar in the reverse direction. The undriven end of the auger housing is open and adapted for slip-on attachment of an extrusion mold which shapes the mortar into the desired curbing shape. At its other end, which is closed, the auger shaft is supported and driven to rotate the auger. Near the closed end, the auger housing has a flanged feed aperture on its upper side which comprises an inlet for introducing the mortar or mortar-like material into the auger tube for compression and extrusion. A hopper has a lower flanged outlet which matches the feed aperture of the auger housing and extends upwardly for holding a supply of mortar or mortar like material for forming the curbing. The hopper flange abuts the feed aperture flange and is held in place by a fixed flange retainer at one end of the flanges and by a lever-clamped finger or fingers along the other end of the flanges. The lever is held in place during operation by an ear attached to the hopper wall, resulting in a hopper which is tighly held in position during operation, but which may be removed from the machine merely by moving the lever.

The mold has a rear extrusion portion having a top and two sides. The rear end and bottom are open. The forward end of the mold is closed, except for an open sleeve which is designed to be slipped over the open outlet end of the auger housing. The front of the mold also has a generally horizontal mold guide or skid plate extending forwardly therefrom and fixedly attached thereto. It terminates in a turned-up front edge and slides on the ground surface to guide the mold with respect to the level of the ground surface. The edges of the mold skim the ground surface at the proper elevation. Also, the curbing may be laid immediately next to the lawn edge or driveway edge because the mold has no outboard runners or flanges.

The auger is driven by a small hidraulic motor having a high torque. The hydraulic motor is driven by pressurized hydraulic fluid from a variable displacement pump which is, in turn, driven by a motive means which is preferably a fueled engine, such as a gasoline engine. Other motive means, such as an electric motor, may be used, but the latter has the disadvantage of requiring long electrical cords, and is dependent upon the available electrical supply, which may vary. Furthermore, the fueled engine is rigidly attached to the auger housing, in order that the normal engine vibrations will enhance the flow, deaeration and compaction of the cementitious material in the hopper, auger and mold. The strength of the resulting curbing is reduced when there is insufficient vibration to deaerate the cement. This is more likely to occur when an electric motor is used.

The variable displacement hydraulic pump 11 is preferably a pump, known in the art, which develops high pressure at low flow and low pressure at high flow. the pressure at which flow is essentially zero is adjustable, up to 3000 psi or higher. Pump 11 uses a minimum of power to produce the preset pressure.

The motive means needs only to operate at a single RPM. The motive means is mounted over the discharge end of the auger housing, and provides the proper weight balance. We have found that use of a hydraulic system to transfer power from a rear mounted motor or engine is much better than using a long shaft and belt drive, because the hydraulic system introduces a very simple and reliable means to control the speed. Controlling the speed of a gasoline engine or electric motor over a wide range of RPM, without sacrificing the required torque, is difficult to achieve.

We have found that the HP required to achieve the desirable high laying speed is about 0.16–0.22 HP per square inch of curb cross-sectional area. In other words, each HP will produce 4.5–6 square inches of curbing cross-sectional area. A prototype machine with a 3 HP gasoline engine and a 4 inch auger operating at 85–95 RPM produced a 12 square inch cross-sectional area curbing at 12–16 feet per minute. As this speed, the limiting factor is not the machine speed, but the rate at which mortar or concrete can be supplied to the machine. Several persons using wheelbarrows may be unable to keep up with the machine's consumption of cementitious material.

The front or driven end of the auger assembly, together with the hopper, are supported on a wheeled carriage. The carriage is slidable from side to side, enabling operation close to walls, trees or other obstructions, and has one or more steerable wheels mounted at each end. Each wheel assembly is vertically adjustable to accommodate sloped surfaces.

The particular design or selection of components and their arrangement results in an apparatus for extruding and laying curbing which is particularly advantageous. Although certain particular elements have been disclosed in the art, the component design, combinations, and arrangement herein claimed which produce high quality decorative curbing at a high velocity, under widely varying conditions, with minimum effort, and without the use of stationary forms, has never before been disclosed or used.

BRIEF DESCRIPTION OF THE DRAWINGS

Other features, aspects and advantages of the invention will hereinafter become apparent from the following detailed description and the appended drawings.

DESCRIPTION OF THE PREFERRED EMBODIMENTS

It will be understood that the components of the present invention, as described in the specification and figures, may be arranged and modified in many configurations without departing from the scope of the invention as claimed. Thus, the following description and figures of the drawings are intended to represent and exemplify the preferred embodiments of the invention.

In all of the drawings, like elements and parts are designated with like numbers throughout.

Figure 1:
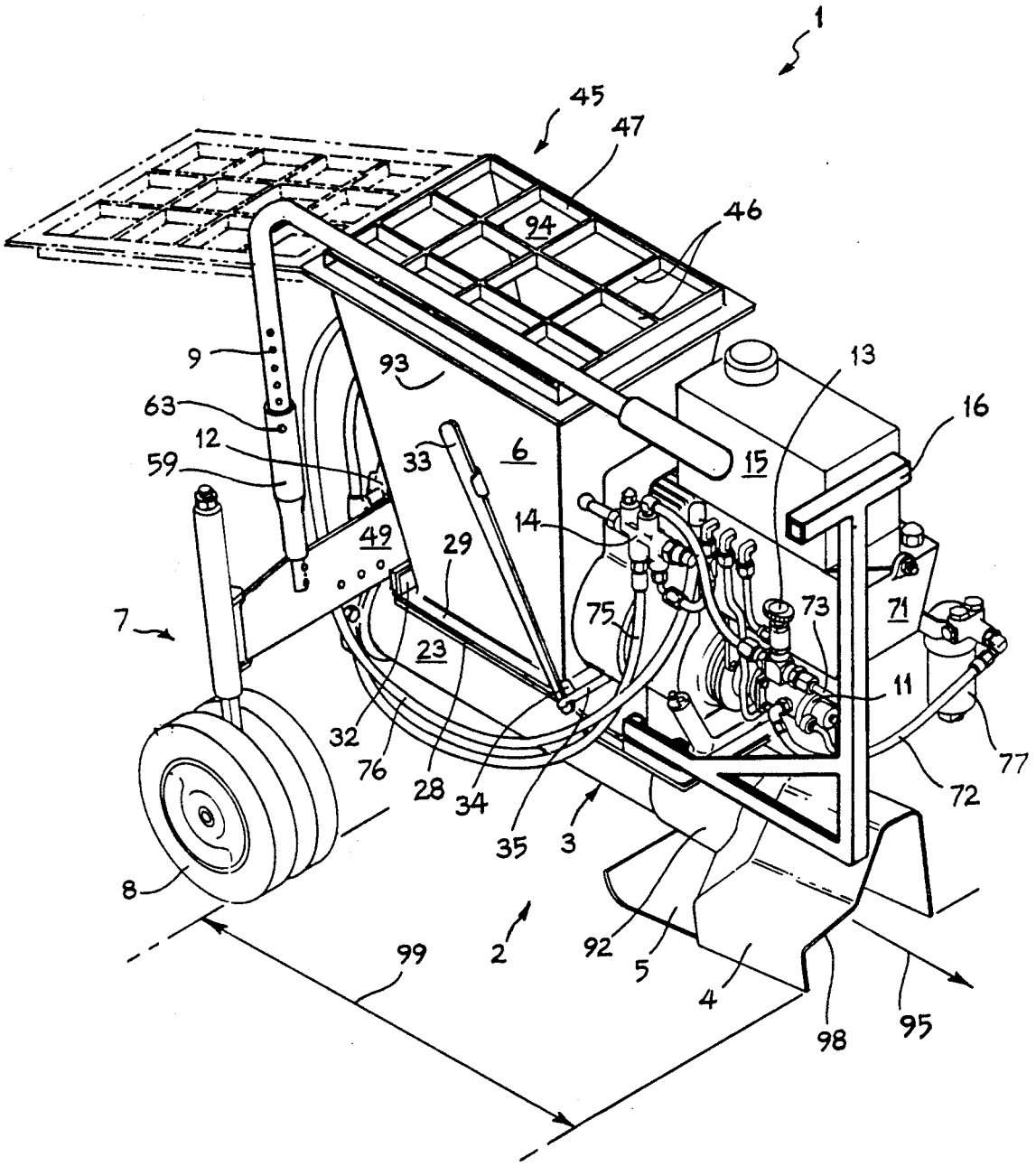
FIG. 1 is a perspective view of the curb extrusion and laying apparatus showing one preferred embodiment of the present invention.

Turning now to FIG. 1, one embodiment of the invention is shown in perspective. Curb laying machine 1 is comprised of six major sections, each of which contributes to the unique operation of this machine. These six assemblies are:

a. compression and extrusion assembly 2, including an auger subassembly 3 and extrusion slip-form mold 4 with mold guide or skid plate 5 and attachment sleeve 92;

b. hopper 6 for storing and feeding the mortar or other cementitious material;

c. chassis 7 including one or more wheels 8, together with steering mechanism 9, for supporting and guiding the forward portion of the curb laying machine;

d. hydraulic drive assembly 10 for rotating the auger 3, including hydraulic pump 11, hydraulic drive 12 having particular operating characteristics, control valves 13 and 14, and interconnecting pressure conduit;

e. motive means 15 for driving the hydraulic pump 11; and f. guide handle 16 for guiding the mold in the desired path.

The six major assemblies are combined in an apparatus having a very short overall length for maneuverability in confined aresa, and a short support base, ie., the distance between front wheels and rear mold guide is minimized to provide a short turning radius often required in layingdecorative curbing. Additionally, sufficient compression zone length, ie., useful auger length, is provided at a near-optimum length, so that the overall machine length is minimized. Thus, the machine is highly maneuverable, operated with simple controls, lightweight, easily adapted for changing conditions, and easily maintained.

In order to achieve these desirable features, motive means 15 is mounted atop the extrusion end 17 of auger housing 23 and hopper 6 is mounted atop the opposite, or driven end 17*a* of auger housing 23.

Figure 2:
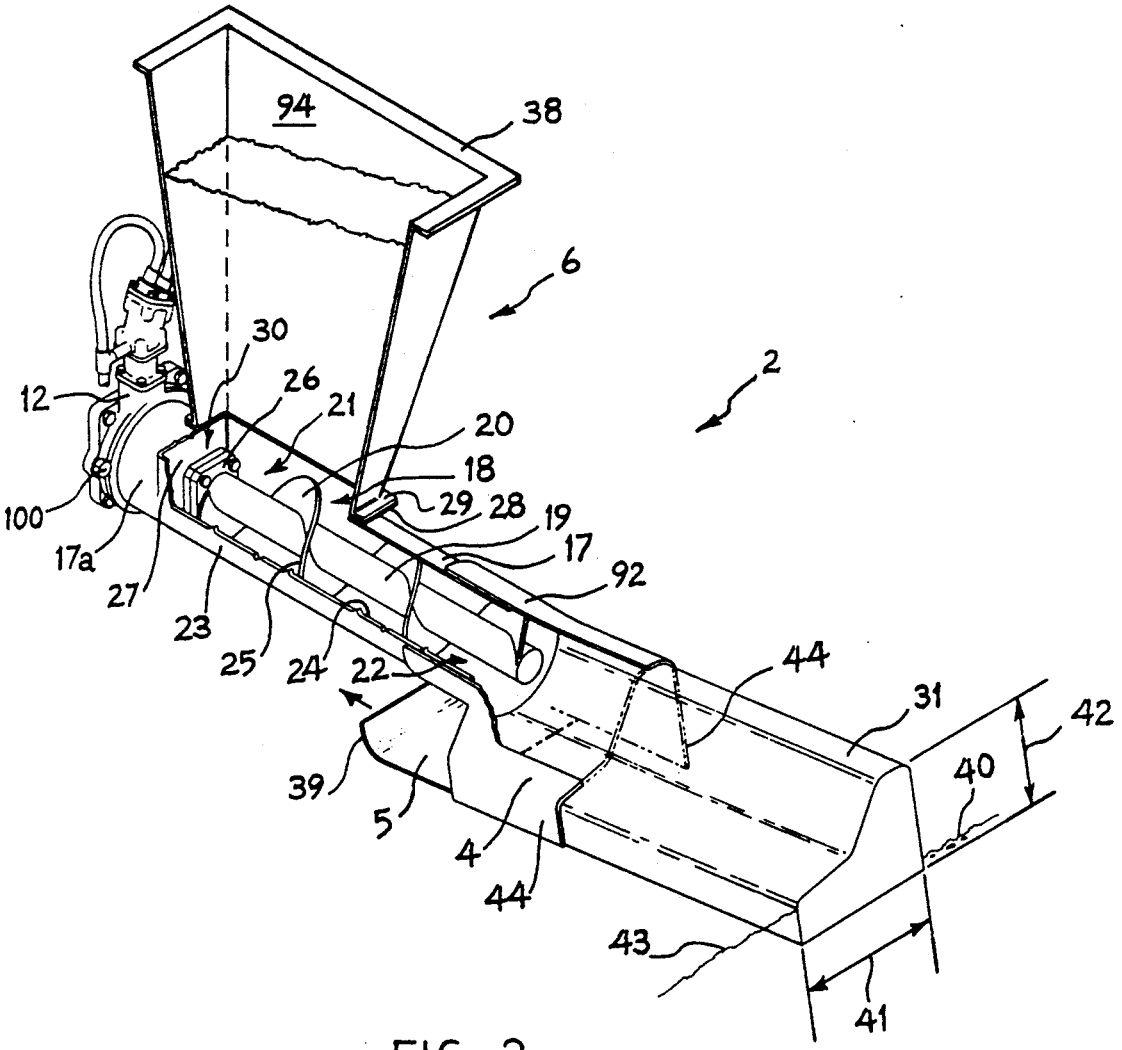
FIG. 2 is a perspective view of the compression and extrusion assembly, and hopper of a preferred embodiment of the invention.

Compression and extrusion assembly 2 is more clearly shown in the cutaway view of FIG. 2. Auger 18 includes shaft 19 and auger flight 20, and has a supported driven end 21 and an opposite, unsupported end 22 which discharges the compressed, deaerated mortar into shaped extrusion slip-form mold 4. The auger preferably has a flight diameter of 4–8 inches, depending upon the available drive RPM and the size of curbing to be produced. The auger flight 20 is preferably constructed of wear resistant material, at least along the outer periphery.

An auger housing 23 surrounds auger 18, having its inner surface 24 nearly proximate the circumferential edge 25 of the flight 20, permitting only a very slight slippage of mortar in the reverse direction past the flight. Shaft 19 is shown supported by bearing 26 mounted on a transverse wall 27 within housing 23. This wall 27 extends upward from the housing, and becomes part of an auger housing inlet 30 which has a feed flange 28 at its upper edge. Flange 28 abuts the hopper flange 29 of hopper 6 and is easily attached to it for extrusion, and detached for cleaning or transportation. Thus, hopper 6 is mounted on the auger housing 23 at the supported, driven end 21, providing a sufficient length of compression by the rotating auger 18 to mix, deaerate and compress the mortar or other cementitious material for subsequent extrusion through mold 4. As the mortar is extruded from mold 4, the reactive force propels the curb laying machine forward.

The auger housing 23 containing the auger 18 slopes downward from the driven end 21 to the extrusion end 22. This angle may vary from 5 to 45 degrees, but is preferably between 5 and 30 degrees, depending upon the viscosity of the material being extruded. Very viscous, relatively dry concrete may be more readily extruded when the auger angle is greater, such as 10–45 degrees from the horizontal.

In the preferred form, hopper 6 has flange 38 on its upper edge. A polygonal hopper with a rectangular cross-section as shown has opposite planar sides 93 and 94 parallel to the direction 95 of mortar passing through mold 4. The machine operator may use either side 93 or 94 to sight along the intended path, thus maintaining accurate laying of the curbing. Furthermore, a polygonal hopper is preferred for ease of construction, strength, and to limit the width of the hopper for a given capacity. This enables the laying of curbing close to obstructions, at least to within 6 inches of a wall, tree, or other obstruction.

In FIG. 2, mold 4 is shown having a typical shape for producing decorative curbing 31. Although molds for producing curbing of any shape may be used, one application of this machine is especially designed to produce decorative curbing, which is generally of much smaller cross-section than highway curbing. For example, mold 4 will typically produce a curb having a width 41 of 5 to 6 inches, and a height 42 of 3 to 5 inches. On the other hand, a street curbing of the same design may typically be about 12–16 inches in width and about 8–12 inches in height. Thus, the cross-sectional area of decorative curbing is typically about ½ to ¼ that of street curbing.

The mold 4 has a circular attachment sleeve 92 which fits over the extrusion end 17 of the auger housing. This permits the mold to be easily attached by press-fitting it onto the auger housing. Likewise, it is easily removed. The mold may be easily attached at any angle so that the mold guide 5 will fully contact the ground surface or other surface and produce the desired curbing. If a curb having a tilted cross-section is desired, it may be produced by grading the ground at an angle, and tilting the mold at the same angle.

In a somewhat larger version of this machine, curbing of up to 40 to 48 square inches may be produced, using a larger (e.g. 8 inch diameter) auger and greater motor HP, such as 10 HP.

Typically, the surface of the ground along the curbing path is subgraded in advance to provide a level base 40 upon which the curbing is laid. The depth of subgrading is controlled so that the ground level 43 on at least one side of the curbing will intersect the curbing at the desired level and provide the required elevation change across the curb.

A mold guide 5 comprises a flat member at the leading edge of the mold 4, with a turned-up front edge 39. The guide 5 slides on the base 40, typically soil, and prevents the sides 44 of mold 4 from penetrating base 40.

FIG. 2 also shows hydraulic drive 12 attached by bolts 100 to auger housing 23. The controlled rotative output of drive 12 turns auger 18 over a wide range of speed, for example, from zero to 100 RPM. Molds having large cross-section require more mortar per foot of length, so operation at the same linear velocity requires that the auger be rotated at a higher RPM. Such control is simply accomplished with this machine merely by changing the setting of speed control valve 13.

Turning back to FIG. 1, means for attaching hopper 6 to feed flange 28 includes a fixed flange retainer 32 which holds down hopper flange 29 against flange 28 on one side of the hopper. In this FIGURE, retainer 32 is shown in contact with the forward edge of hopper flange 29, and is attached to auger housing 23. On the opposite side of hopper 6, which in this FIGURE is the trailing side, finger or fingers 34 on lever 33 compressively clamp the flanges 28 and 29 together, using rod 35 as a fulcrum. The upper end of lever 33 is then retained by ear 36 attached to the exterior wall 37 of the hopper, for tightly holding the hopper 6 in place.

Figure 3:
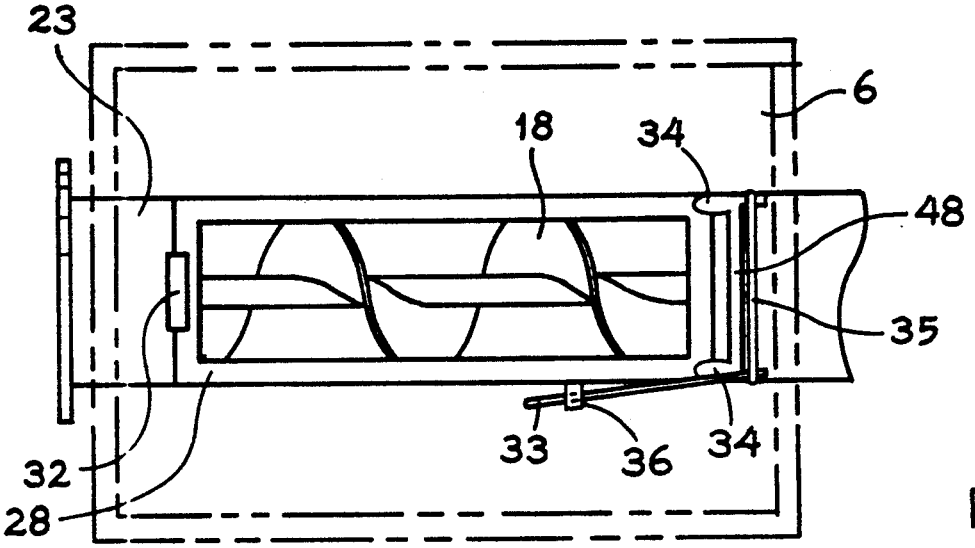
FIG. 3 is a top view of the means for attaching the feed hopper to the auger housing.
Figure 4:
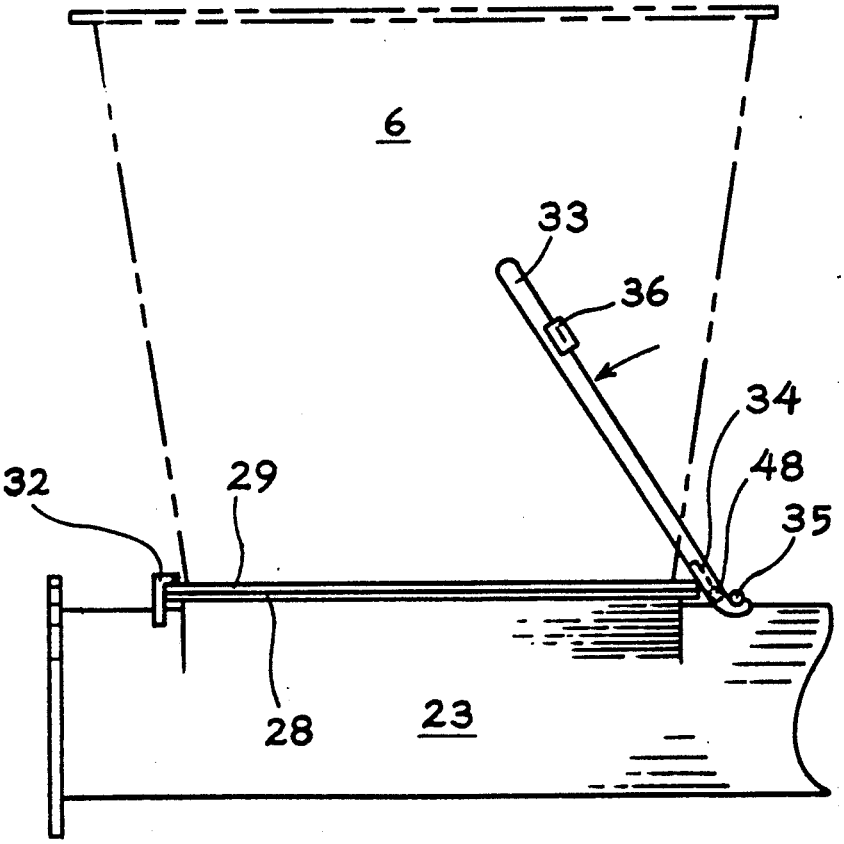
FIG. 4 is a side view of the means for attaching the feed hopper to the auger housing.

A preferred form of this means for attaching hopper 6 to the auger housing 23 is more clearly shown in FIGS. 3 and 4. Fixed flange retainer 32 attached to auger housing 23 holds hopper flange 29 down against feed flange 28. At the opposite side of the hopper 6, shown in phantom, rod 35 is attached, as by welding, across auger housing 23 as a fulcrum for lever 33. Attached to the lower end of lever 33 at an approximate right angle is connecting rod 48, which spans the auger housing. Fingers 34 are attached to each end of rod 48 for pressing and holding down hopper flange 29 down against feed flange 28 when lever 33 is moved forward according to the arrow in FIG. 4. lever 33 is then hooked behind ear 36 to maintain the hopper in the operating position.

An optional adjunct to this machine is grate 45, illustrated in FIG. 1. Grate 45 is shown with a framework 47 which is optionally hinged to the forward upper edge of the hopper, so that it may be opened for cleaning. Grid members 46 span the grate framework 47 and are attached thereto, providing openings having an average width of 0.8 to 3 inches through which the feed material is poured into the hopper. Grid members 46 are shown as bars with rectangular or triangular cross-section. The grate serves as a safety feature, preventing operators from injury by the auger 18 rotating in the auger housing inlet 30. It also ensures that chunks of mortar which may be in the feed material will be cut into smaller size as they pass into the hopper.

Figure 13:
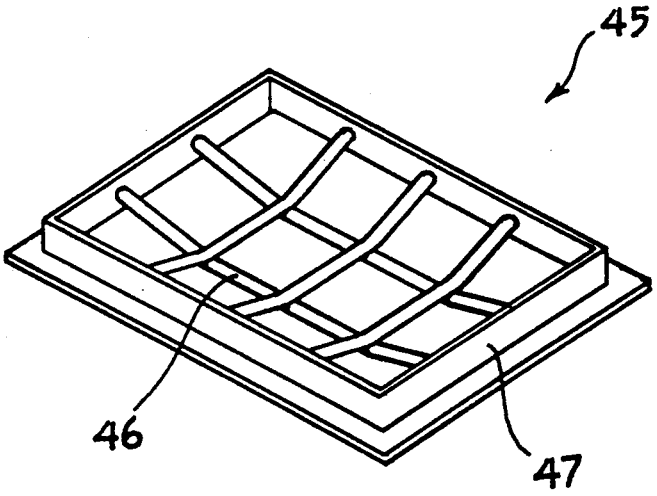
FIG. 13 is a perspective view of an alternate hopper grate.

FIG. 13 shows an alternate form of hopper grate 45, in which grid members 46 are round rods attached at each end to grate framework 47. In a preferred embodiment, the rods are recessed downward in their midsections to prevent mortar from spilling when poured into the hopper. The spacing between grid members 46 need only be large enough to prevent persons from inserting their hands into through the grate and into the hopper during operation, yet allow the refilling of the hopper with mortar. The width of the rods or bars is limited to enhance the ease of filling the hopper. Preferably, the width of the grid members is ⅛–¼ inch, and most preferably, about ⅛ inch.

Figure 5:
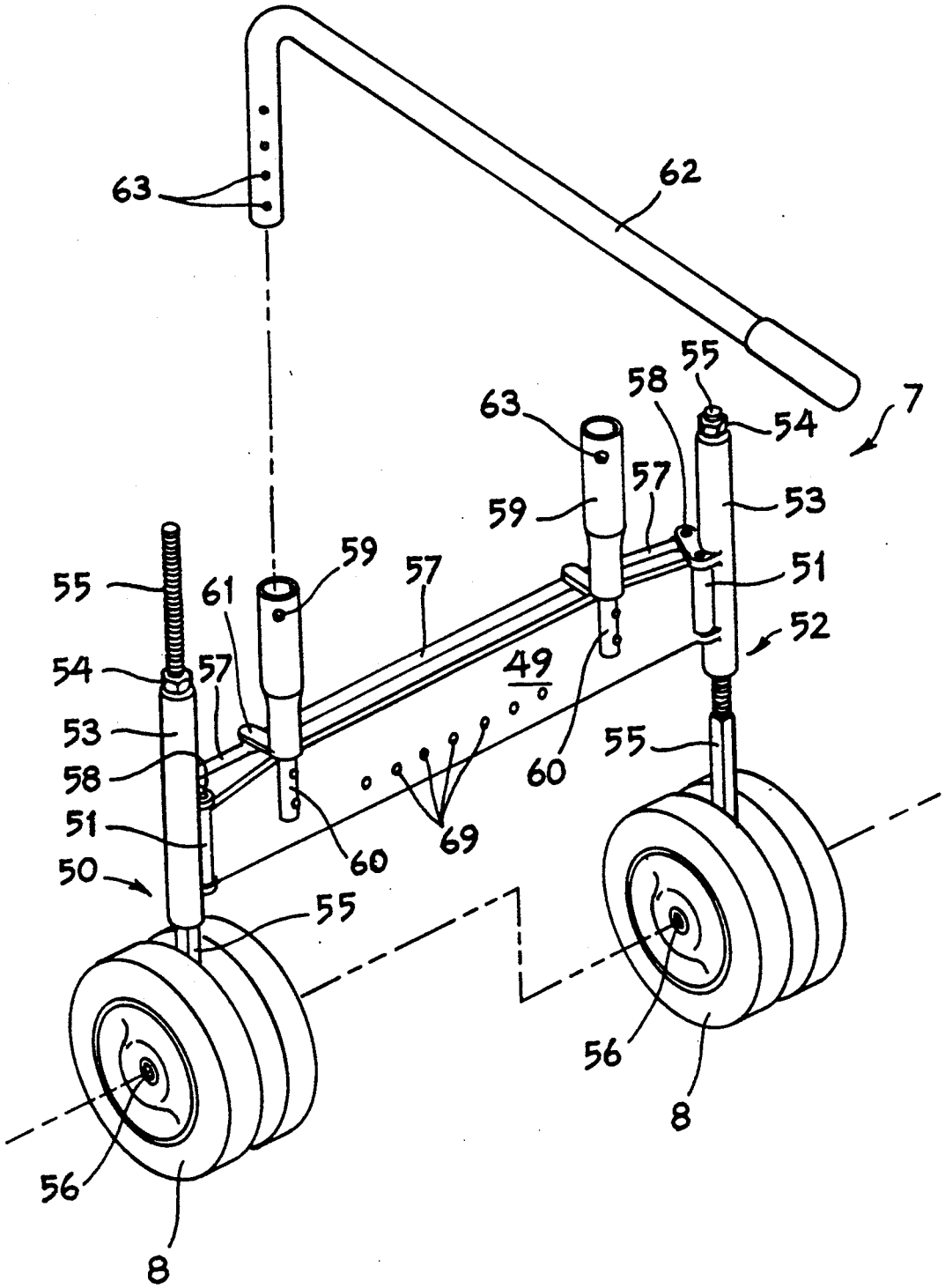
FIG. 5 is a perspective view of the chassis of one embodiment of the invention.

In FIG. 5, chassis 7 and steering mechanism 9 are shown in greater detail. Crossbar 49 connects opposing wheel carriages 50, to which it is connected by hinges 51 so that the carriages may be rotated in unison for steering the apparatus. Each carriage 50 comprises an elevation adjustment column 53 having an attached rotatable nut 54. Such apparatus is well known in the art. A threaded strut 55 passes through each of the columns 53 and extends downward to be connected to axle 56 of wheel or wheels 8. The elevations of the wheels are adjustable upwards or downwards by turning bolts 54. In this FIGURE, the left wheels are shown in an upper position while the right wheels are in a downward, extended position. Such a position is advantageous when operating on the side of a hill or slope, to keep th curbing in the desired attitude. The wheels 8 of both the left and right sides are adjustable, for operating in any direction on slopes.

The directional position of the opposing carriages is coordinated through tie rod or rods 57, to which the carriages are hinged at extensions 58. The tie rods 57 are generally parallelly spaced from crossbar 49, and from the axis of each elevation adjustment column 53 by up to 5 inches, but preferably about 3 inches. Near each end of crossbar 49 is a steering handle holder 59 which rotates on an upwardly extending post 60 attached to the crossbar. Attached to holder 59 is one end of steering finger 61, and the other end of finger 61 is hingedly attached to one of tie rods 57. The upper portion of steering handle holder 59 is adapted to accept one end of steering handle 62 and lock it in position. Thus, the L-shaped steering handle 62 may be placed in either of the holders 59, on either side of the hopper 6, for steering the apparatus from a position at the rear, at the front, or at either side. Handle 62 may be locked in place by placing a screw or pin through holes 63 in the handle and holder. The handle elevation is easily changed by using a different hole 63 in the handle 62.

Figure 7:
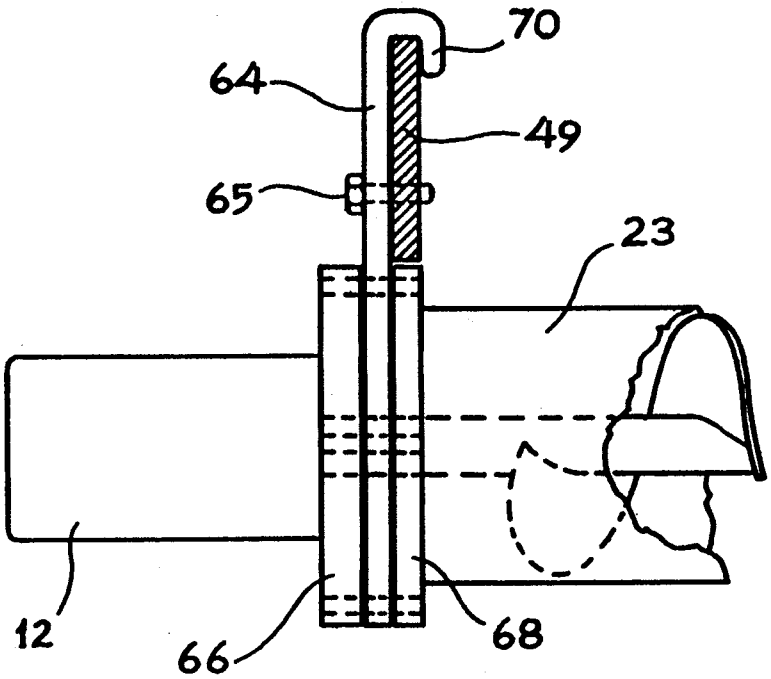
FIG. 7 is a side view of the powered end of the auger housing and crossbar of FIG. 6.
Figure 6:
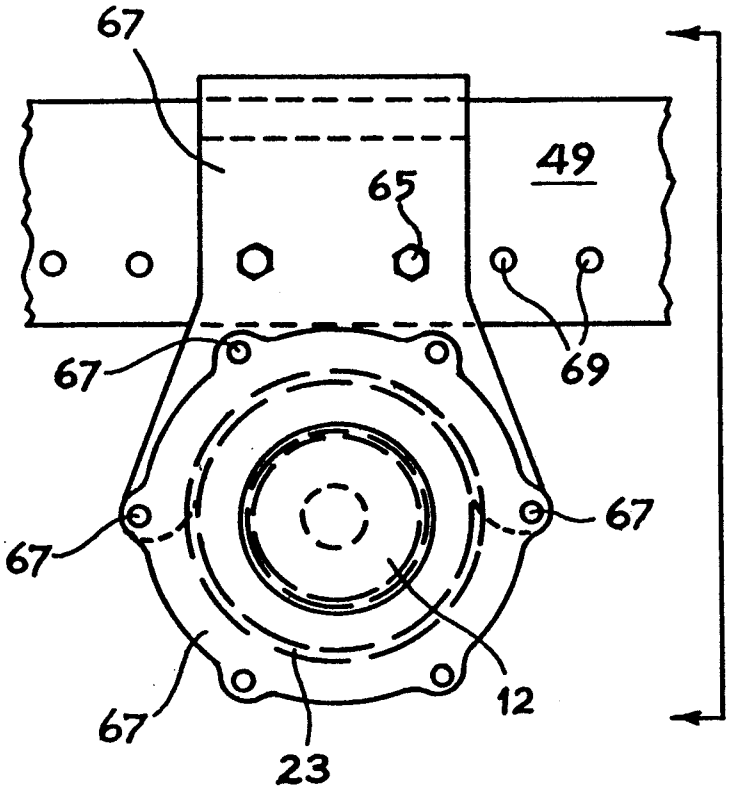
FIG. 6 is an end view of the powered end of the auger housing and a portion of the crossbar of the chassis of the invention.

The compression-extrusion assembly 2 may be connected to chassis 7 in any of a series of locations. The location may be changed in several minutes merely by changing a bolt location, as shown in FIGS. 6 and 7. Looking at these FIGURES now, crossbar 49 passes over auger housing 23 at a right angle and is held in abutment with crossbar holder 64 by the latter's downturned upper edge 70 together with bolts 65. Holder 64 is shown as being attached to assembly 2 by bolts, not shown, which pass through holes 67 in hydraulic motor flange 66, augur housing flange 68 and the crossbar holder 64. Bolts 65 pass through holes 69 in the crossbar 49. These holes may be threaded to match the bolts, or nuts (not shown) may be screwed on the bolt ends to tightly attach the crossbar 49 to the crossbar holder 64. A series of holes 69 in crossbar 49 enables an operator to easily remove the bolts and slide the crossbar to a new position. Thus, the machine may be quickly modified to accommodate operations next to buildings, trees, etc. on either side. Because of this adjustable feature, curbing can be laid laterally to within about 6 inches of walls or other obstructions. The machine remains balanced even when the crossbar is at a sidemost position. When bolts 65 are removed to change the position of the auger assembly on the chassis, the two are held together by holder's curved upper edge 70 so that the auger assembly and chassis do not separate; yet the two are easily separated if desired.

Figure 8:
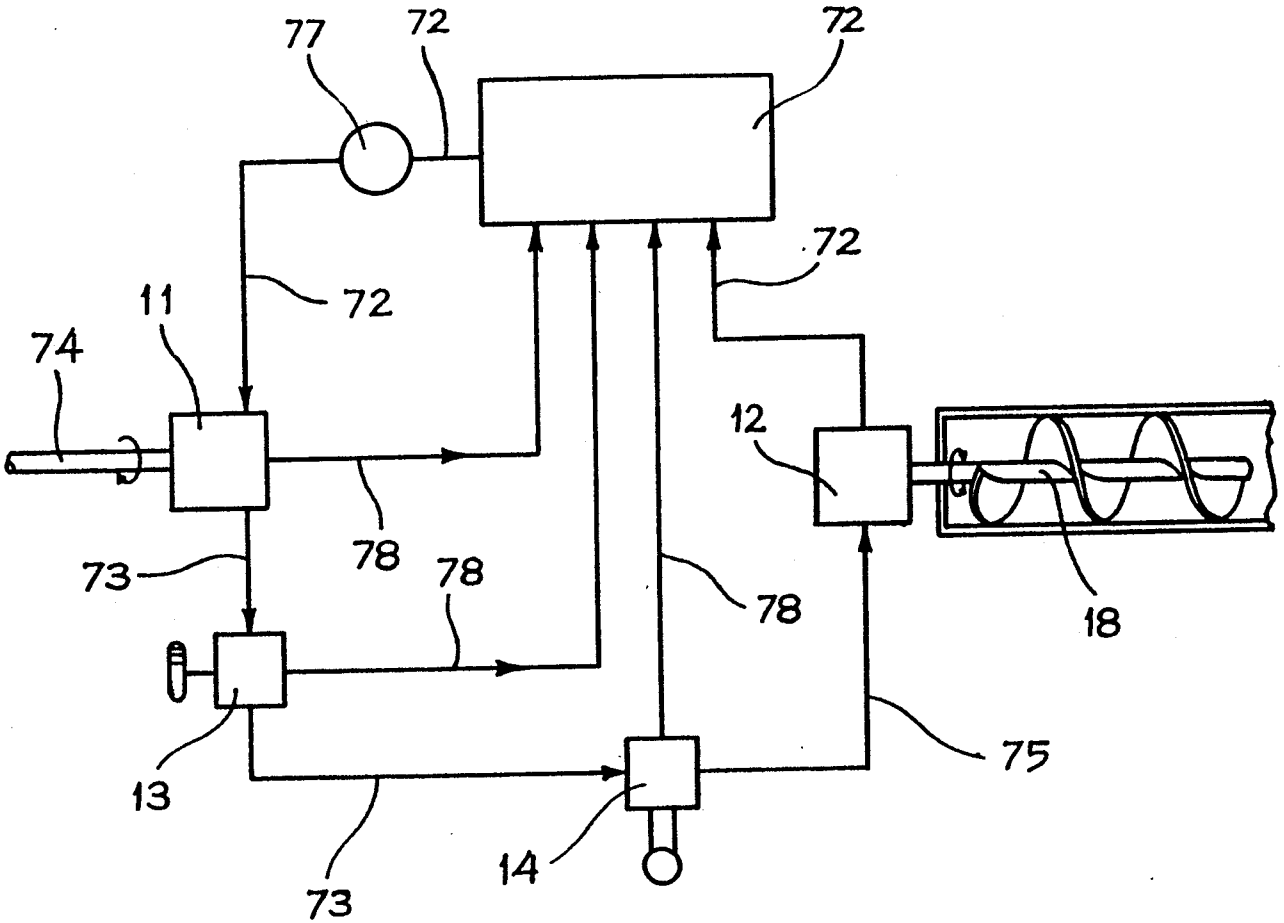
FIG. 8 is a schematic view of the hydraulic drive assembly of the invention.

Turning now to FIG. 8, and looking at it in conjunction with FIG. 1, motive means 15 (not shown in FIG. 8) drives the shaft 74 of variable displacement hydraulic pump 11 to pump hydraulic fluid from fluid reservoir 71, via line 72, to a high working pressure, typically ranging up to about 3000 psi, for example. The maximum pressure is reduced by speed control valve 13 to typically 1200 to 2800 psi during continuous operation. This range in fluid pressure results in about a 3:1 range in auger speed, but the auger speed can be reduced to zero using the speed control valve. Thus, the engine 15 may be started at a no-load, idle condition by opening valve 13. Likewise, the auger may be completely stopped without stopping engine 15, for ease of operation as well as safety. The high pressure fluid passes through pump discharge line 73 to speed control valve 13, and thence to on-off control valve 14. These valves, as well as the hydraulic pump 11 and hydraulic motor 12 are commercially available. Both valves are manually set. The fluid then passes through line 75 to hydraulic motor 12, and then returns to the reservoir 71. Optionally, a filter 77 may be used to remove possible contaminants in the fluid. Excess fluid is passed back to the reservoir from the pump 11 and valves 13 and 14 via lines 78.

The pressures cited are exemplary. Lower pressures, and even somewhat higher pressures, may be alternatively used, provided that the resulting motive forces are sufficient for driving the auger. In general, the hydraulic fluid system should have a maximum working pressure of at least 1000 psi.

Figure 9:
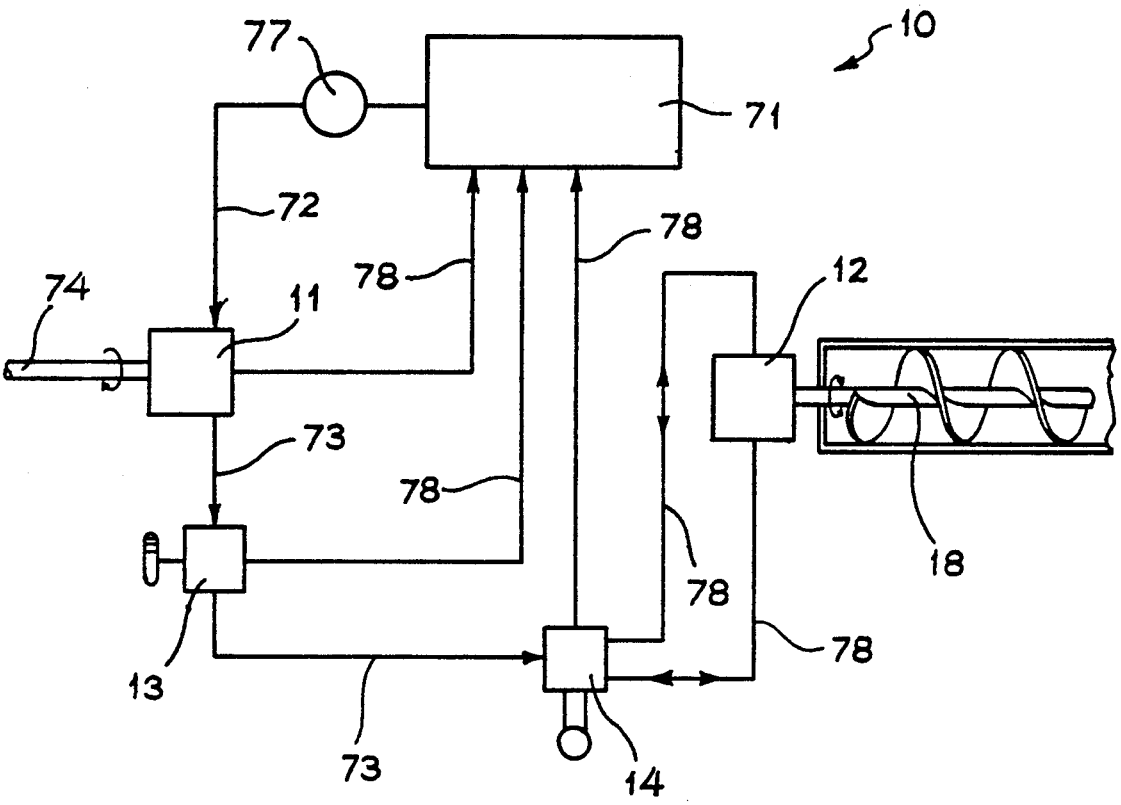
FIG. 9 is a schematic view of another embodiment of the hydraulic drive assembly of the invention.

In another embodiment, illustrated in FIG. 9, on-off control valve 14 is a 4-way valve and hydraulic motor 12 may be operated in either a forward or a reverse direction. Thus, valve 14 may direct the pressurized fluid through line 78 for forward (normal) rotation of auger 18 to extrude mortar or concrete. Alternatively, fluid may be directed through line 79 to reverse the rotation of auger 18. This reversal is useful for washing the auger and auger housing, for instance. Motive means may be any compact motor which will produce the desired power, as previously described. Motive means 15 does not need to have variable speed, since auger speed is controlled in the hydraulic system by self-regulating variable displacement pump 11 and by controlling valve 13. A gasoline powered engine or electrical motor is preferred, but a gasoline engine enables use where electricity is not available. The motor is rigidly mounted to auger housing 23, as by welding. Preferably, the motor is mounted on plate 80 which is attached by welding to auger housing 23. Alternatively, plate 80 may be an extension of feed flange 28. In either case, the rigid mounting enables normal engine vibrations to be transmitted to the auger housing 23 and hopper 6. Use of a fueled engine thus results in a more deaerated, compact cementitious material, and a stronger final product. Use of an electrical motor as the motive means may result in a cured mortar product with lower strength, unsatisfactory for many applications.

In FIG. 1, guide handle 16 is shown attached to the motor and mounting plate 80 and extending upwardly therefrom. Unlike other portable curb laying machines, this machine is normally operated from the rear. The handle enables the operator to maintain precise control over the mold position as the machine moves forward. During operation, the operator controls the mold path by simultaneously controlling the wheel direction with steering mechanism 9 and controlling the cornering path with guide handle 16. Preferably, handle 16 has a T-shaped upper portion and extends toward the rear of the apparatus for ease of operation.

The machine is also operable from the front, or either side, when required by the particular site.

Figure 10:
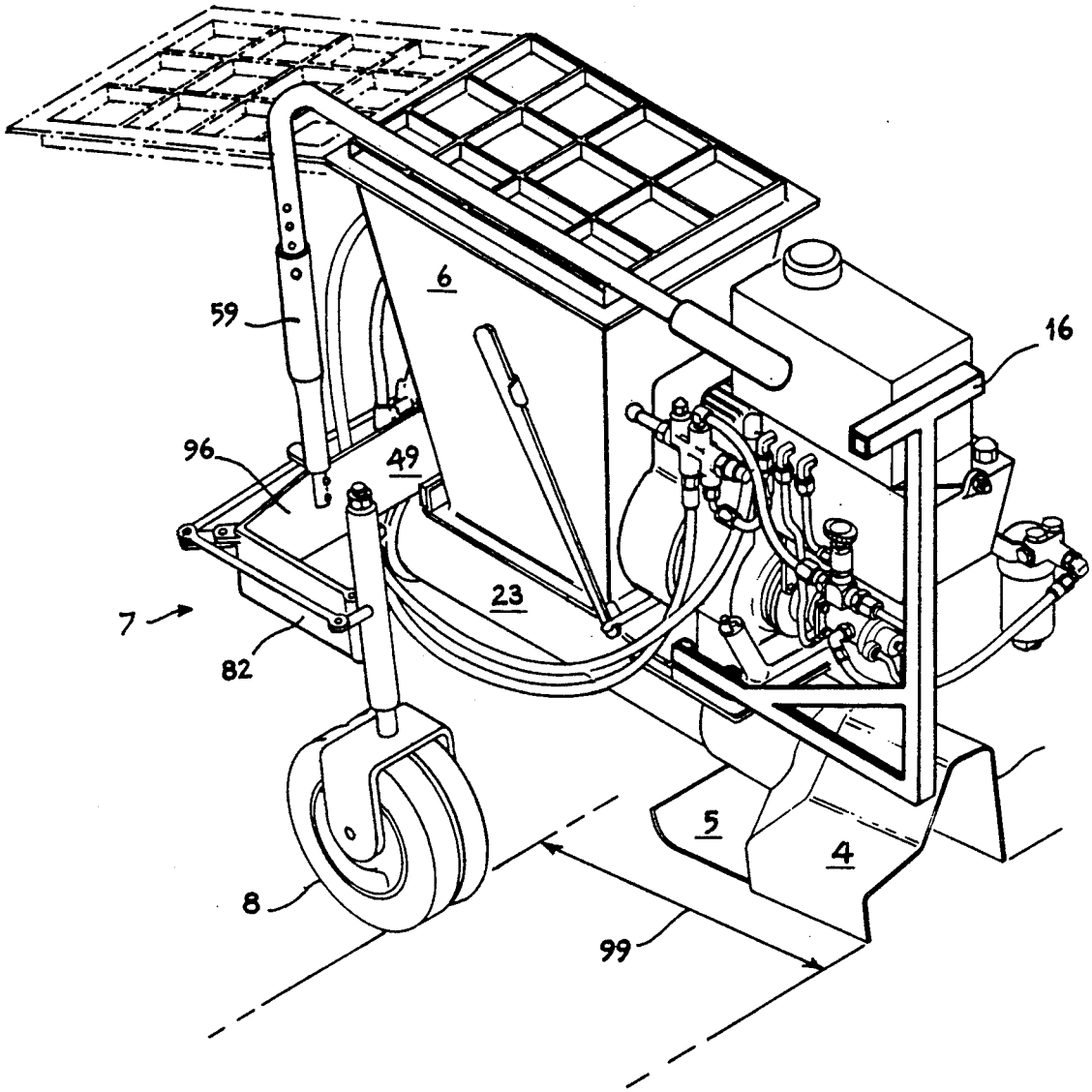
FIG. 10 is a perspective view of another embodiment of the curb laying apparatus of the invention.

A further embodiment of the curb laying apparatus of this invention is shown in FIG. 10. The differences between this embodiment and the embodiment of FIG. 1 reside in the wheeled support 7 and steering mechanism 9. These differences are more clearly delineated in FIG. 11. Crossbar 49 supports the forward end of the curb laying apparatus, and has a central portion 96 which is substantially at a right angle with the auger housing, as looking in the horizontal plane. It has a rearward extensions 82 at each end, each extension terminating at its rearmost end in a hinge 51. A wheel carriage 50 is attached to each hinge 51 for steering. As shown in FIG. 10, this rearward extension shortens the support base 99 between wheels 8 and the outlet end 98 of the mold, enabling very short radius turns to be easily made. In some cases, such turns are necessary to obtain the desired curbing layout.

Figure 11:
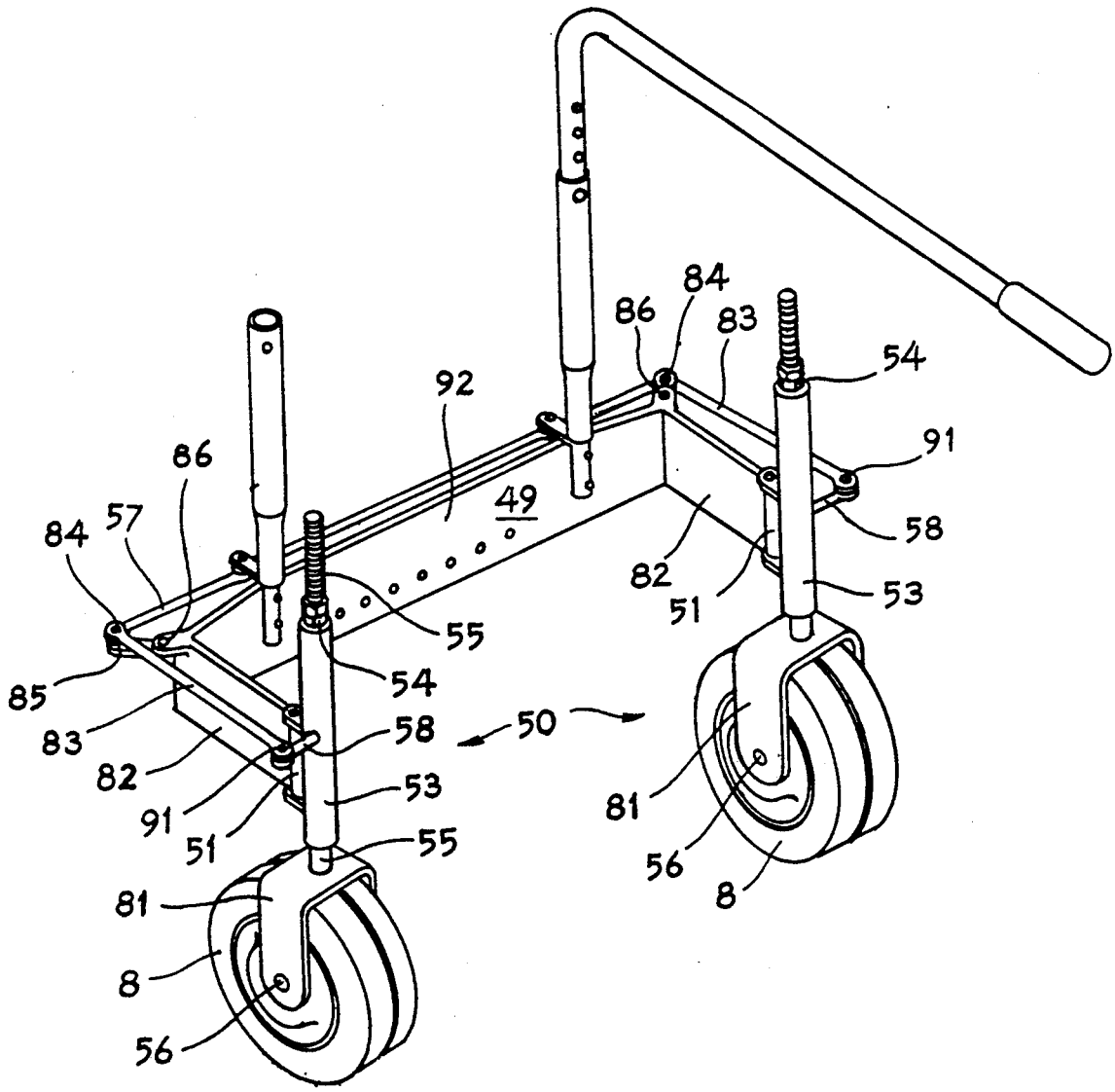
FIG. 11 is a perspective view of the chassis of the embodiment shown in FIG. 10.

In FIG. 11, threaded struts 55 are shown as affixed to U-shaped wheel holders 81, which have axles 56 upon which wheels 8 are mounted. Other means of mounting the wheels may alternatively be used. The apparatus for adjusting the elevation of the wheels is as previously described. As compared to that embodiment, the steering is also the same except that an additional tie rod 83 parallel to each extension 82 is hingedly connected at hinge 84 to tie rod 57, and at hinge 91 to extension 58. Floating bar 85 turns about both hinge 84 and hinge 86, the latter fixedly connected to crossbar 49. In all other respects, the steering apparatus may be as previously described.

Figure 12E:
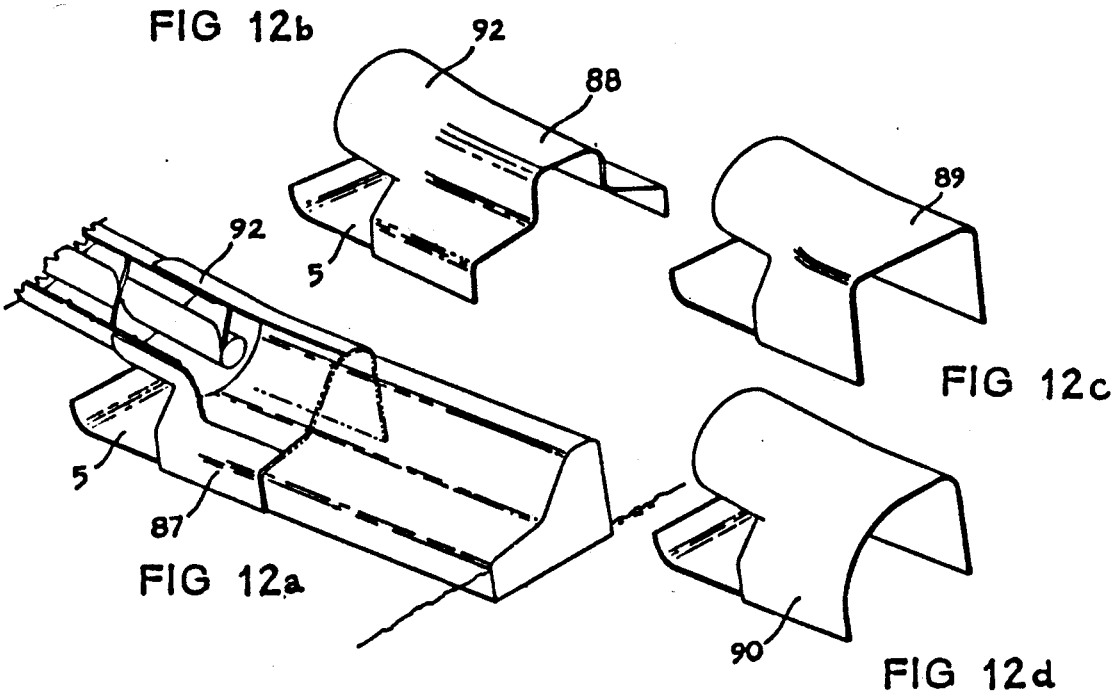
FIG. 12 is a prespective view of four possible molds for producing decorative curbing with different cross-sectional shapes.
Figure 12E:
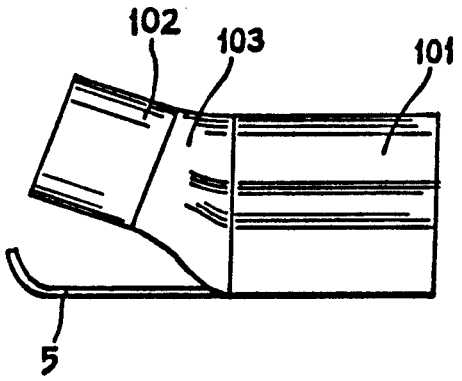

FIG. 12 illustrates several mold shapes which may be used to lay decorative curbing in accordance with this invention. A curb having a single ridge and a single "flat" is produced by the mold 87. A curb having a ridge with a "flat" on each side may be produced by mold 88. Similarly, mold 89 produces a curb with non-curved top and sides, and mold 90 produces a curb with one straight side one curved side. Molds can be made for the described curb-making machine to form and extrude solid curbing of many different shapes. The curbing may be laid in a subgraded bed directly against the bed walls because the mold requires no outboard flange as is common with existing molds. Thus, the material, typically sod and dirt, which is excavated to form the curbing bed need not be significantly wider than the curbing which is to be laid. Extensive back-filling is avoided and the curbing project is completed with less labor and time.

In a preferred embodiment, the mold has a full size outlet section 101 joined to a circular inlet section 102 by a middle section 103. The latter gradually increases in size from the inlet section to the outlet section, as shown in FIG. 12(*e*). As a result, the mortar is gradually expanded from the velocity in the auger housing to the final extrusion velocity and final cross-sectional shape and size. The change in velocity will depend upon the relative cross-sectional flow areas of the auger housing and mold outlet.

While this machine is described as applicable to concrete, mortar and mortar-like materials, any material having similar flow characteristics may be extruded into curbing. Polymeric fibers may be added to the mix to enhance the strength. Colorants or other materials for decorative and/or utility enhancement may also be added to the mortar.

While the instant invention has been particularly set forth in terms of specific embodiments thereof, it will be understood in view of the present disclosure that numerous variations upon the invention are now enabled to those skilled in the art, which variations yet reside within the scope of the present teaching. Accordingly, this invention is to be broadly construed, and limited only by the scope and spirit of the claims now appended hereto.

What is claimed is:

1. An improvement in a manually maneuverable extruder-propelled apparatus for forming and extruding continuous elongated decorative curbing, edging and borders from cementitious materials, said apparatus including:

an auger mounted on an auger shaft supported and rotatively driven at a first end to compress and extrude said cementitious materials axially toward an unsupported second end thereof;

an auger housing surrounding said auger, having an inner surface proximate the outer diameter of said auger by which said material is directed to said second end thereof by said auger, and having said second end adapted for attachment to a mold for extrusion therefrom of said cementitious materials, said auger housing having the opposite, first end thereof closed, and having a feed aperture in said auger tube between said first and second ends for introducing said cementitious materials into said auger tube;

a hopper having an open upper inlet end and an open lower outlet end communicating with said feed aperture;

a mold attachable to said first end of said auger tube, and having a cross section to form and extrude said cementitious materials in a desired curbing shape;

a hydraulic power mechanism for driving said auger within said auger tube at a desired controllable speed, said hydraulic power mechanism including;

a. a hydraulic pump to pressurize hydraulic fluid, b. a hydraulic motor to accept said pressurized fluid to drive said auger shaft, c. speed control means to control the pressure of fluid to said hydraulic motor, d. means to completely open or close the flow of said fluid to said hydraulic motor, and e. conduit means for carrying said fluid from said hydraulic pump to said hydraulic motor, and returning said fluid from said hydraulic motor to said hydraulic pump;

motive means to drive said hydraulic pump to pressurize said hydraulic fluid for driving said auger;

a wheeled carriage having a cross-bar transversely slidable relative said auger housing for supporting the forward end of said curb forming apparatus, and having steerable, vertically adjustable wheels attached to each end of said cross-bar;

wherein the improvement comprises means for controlling said flow of said pressurized hydraulic fluid to either side of said hydraulic motor for controllably operating said motor in either the forward or backward direction.

2. The improvement of claim 1, wherein said flow controlling means comprises a four way valve.

3. The improvement of claim 1, further comprising a guide means attached to the rear of said apparatus for guiding said mold in a desired path.

4. The improvement of claim 3, wherein said guide means is a handle adjustable to be manually accessible from the rear or either side of said apparatus.

5. The improvement of claim 1, further comprising a steering handle for steering said wheels, said steering handle adjustable vertically and rotatably adjustable to be operable from the front, rear or either side of said apparatus.

6. The improvement of claim 5, further comprising one or more handle holders mounted on said cross-bar, a tie rod connecting said end attached wheels, and a finger connecting each said handle holder to said tie-rod for pivotal steering of said wheels about the vertical axes thereof.

7. The improvement of claim 6, wherein two or more said handle holders are mounted on said cross-bar for alternate attachment of said steering handle on either side of said apparatus.

8. The improvement according to claim 1, wherein said mold includes a flat skid plate extending forwardly from said rear extrusion portion and having a turned up front edge for sliding on said ground and guidably supporting said mold, said rear extrusion portion closedly attached to said sleeve and fixedly attached to said flat skid plate.

9. The improvement according to claim 1, wherein said mold has a generally circular attachment sleeve for attaching by pressfitting said mold over the oulet end of said auger housing at any angle about the axis of said auger housing.

10. The improvement of claim 1, further comprising:

an auger tube flange fixedly attached to said auger tube and circumscribing said feed aperture;

a hopper flange fixedly attached to and circumscribing said open lower outlet of said hopper, and adapted to match said auger tube flange for mounting of hopper thereon;

means for detachably locking said hopper to said auger tube including:

a fulcrum rod fixedly attached across the top of said auger tube;

a locking ear attached to said hopper;

a lever having a first end adapted to removably rotate about said fulcrum rod and the opposite end adapted to be held by said locking ear; and a finger attached to said lever for pressing downward on said hopper flange and locking said hopper to said auger tube when said opposite end of said lever is held by said locking ear.

11. The improvement of claim 10, further comprising a connecting rod rigidly attached at a first end to said lever at a right angle and having its opposite end adapted to removably rotate about said fulcrum rod, and means attached to said connecting rod for pressing downward on said hopper flange and locking said hopper to said auger tube when said opposite end of said lever is held by said locking ear.

12. The improvement of claim 1, wherein said hydraulic pump is adapted to pressurize said hydraulic fluid to a pressure of at least 1000 psi.

13. The improvement of claim 1, wherein said crossbar of said wheeled carriage includes a central portion generally normal to said auger housing and a rearward extending portion at each end of said central portion terminating in hingedly attached, steerable, vertically adjustable wheels, said wheeled carriage being laterally adjustable relative said auger housing.

* * * * *